US007281356B2

(12) United States Patent
Sanftleben et al.

(10) Patent No.: US 7,281,356 B2
(45) Date of Patent: Oct. 16, 2007

(54) MODULAR BRACKET WITH SELECTABLE RADIUS FOR SUPPORTING PASSAGE CORES FOR CONCRETE STRUCTURES

(75) Inventors: Jeff Sanftleben, Canby, OR (US); Douglas E. Bowen, Tualatin, OR (US)

(73) Assignee: Bowco Industries, Inc., Canby, OR (US)

( * ) Notice: Subject to any disclaimer, the term of this patent is extended or adjusted under 35 U.S.C. 154(b) by 552 days.

(21) Appl. No.: 10/794,644

(22) Filed: Mar. 5, 2004

(65) Prior Publication Data

US 2004/0168395 A1 Sep. 2, 2004

Related U.S. Application Data

(63) Continuation-in-part of application No. 10/256,960, filed on Sep. 27, 2002, now Pat. No. 6,715,247.

(51) Int. Cl.
*E04C 2/52* (2006.01)

(52) U.S. Cl. ..... 52/220.8; 52/220.3; 248/68.1

(58) Field of Classification Search ..... 52/180, 52/181, 403.1, 698, 704, 220.1, 220.3, 220.8, 52/98, 100, 216, 576, 323, 350, 660, 663, 52/590.2, 590.6; 249/89, 176, 207, 210; 248/49, 68.1, 73, 74.1

See application file for complete search history.

(56) References Cited

U.S. PATENT DOCUMENTS

| | | | | |
|---|---|---|---|---|
| 3,856,246 | A * | 12/1974 | Sinko | 248/68.1 |
| 4,075,803 | A * | 2/1978 | Alesi, Jr. | 52/220.8 |
| 4,618,114 | A * | 10/1986 | McFarland | 248/65 |
| 6,902,138 | B2 * | 6/2005 | Vantouroux | 248/68.1 |
| 2005/0116123 | A1 * | 6/2005 | Bailey et al. | 248/74.1 |

* cited by examiner

*Primary Examiner*—Richard E. Chilcot, Jr.
*Assistant Examiner*—William Gilbert
(74) *Attorney, Agent, or Firm*—Langlotz Patent Works Inc.; Bennet K. Langlotz

(57) ABSTRACT

A support module interconnects with other support modules to support a number of core elements for encapsulation within a concrete structure. The module has a planar frame defining first and second cutouts. Each cutout has an arc shape so that when modules are assembled, the cutouts of different modules define a circular aperture for closely receiving one of the core elements. Each cutout has a first peripheral arc portion and a concentric second arc portion larger than the first portion. The first portion provides an aperture of a first diameter, and upon removal of the first portion, the second portion provides an aperture of a larger second diameter. The frame having connection elements that to connect with other support modules to securely receive the core elements. The module may include a separately formed arcuate insert fastened to the cutout to provide a smaller aperture.

19 Claims, 6 Drawing Sheets

MODULAR BRACKET WITH SELECTABLE RADIUS FOR SUPPORTING PASSAGE CORES FOR CONCRETE STRUCTURES

REFERENCE TO RELATED APPLICATION

This is a Continuation-In-Part of U.S. patent application Ser. No. 10/256,960, filed Sep. 27, 2002, now U.S. Pat. No. 6,715,247 entitled Modular Bracket for Supporting Passage Cores for Concrete Structures.

FIELD OF THE INVENTION

The invention relates to facilities cast into concrete structures, and more particularly to apparatus for forming passages in concrete walls for later passage of wires, conduits, and pipes.

BACKGROUND AND SUMMARY OF THE INVENTION

In the manufacture of concrete walls, such as those that make up underground utility vaults, it is useful to have pre-cast apertures available for penetration by pipes, conduits, wires and the like. Such apertures have been provided by positioning core elements between the forms used to cast the wall or vault, so that the cores exclude concrete from the desired locations. To provide circular apertures, cylindrical core elements are employed. The cores may have some compressibility or rim gaskets to accommodate variations in form spacing and remain flush against the form surfaces during casting, to ensure that concrete does not enter the desired voids. The cores normally include a cap, membrane, or other barrier that is readily removed or opened when passage is desired, but which seal out dirt and groundwater from the vault.

One difficulty with casting multiple cores is securing them in a desired position. One past approach is to secure them to one of the form boards. This is time consuming, can lead to irregular positioning, and damages the form boards over time. To avoid these problems, systems exist with solid panels having apertures arranged in a matrix to receive a number of cores. Each such panel has a defined number of apertures in which cores may be installed prior to casting. These are normally fastened to a form board, leading to form damage over time. In addition, a different size and shape of panel must be manufactured and stocked for each possible configuration of holes, leading to increased inventory costs. The inventory concern is only partially addressed by modular panels that employ modular strips that are assembled to form a matrix of apertures. Such existing modules are elongated members with several semicircular cutouts on one or both sides. The length of the module determines the number of apertures in each column, and the number of modules determines the number of rows in the matrix. Again, this system requires inventorying a variety of different lengths. Moreover, it generates only rectangular arrays, when other shapes may be desired (and when a rectangle large enough to encompass the desired shapes would be wasteful of material or conflict with other elements in the intended structure.)

Another problem with existing systems is that there is occasionally a need to accommodate cores, sleeves, or pipes of different diameters in a single assembly. Manufacturing and stocking of a wide variety of part sizes increases costs and inventory burdens.

The embodiment disclosed herein overcomes these disadvantages by providing a support module that interconnects with other support modules to support a number of core elements for encapsulation within a concrete structure. The module has a planar frame defining first and second cutouts. Each cutout has an arc shape so that when modules are assembled, the cutouts of different modules define a circular aperture for closely receiving one of the core elements. Each cutout has a first peripheral arc portion and a concentric second arc portion larger than the first portion. The first portion provides an aperture of a first diameter, and upon removal of the first portion, the second portion provides an aperture of a larger second diameter. The frame having connection elements that to connect with other support modules to securely receive the core elements. The module may include a separately formed arcuate insert fastened to the cutout to provide a smaller aperture

DETAILED DESCRIPTION OF A PREFERRED EMBODIMENT

Figure 1:
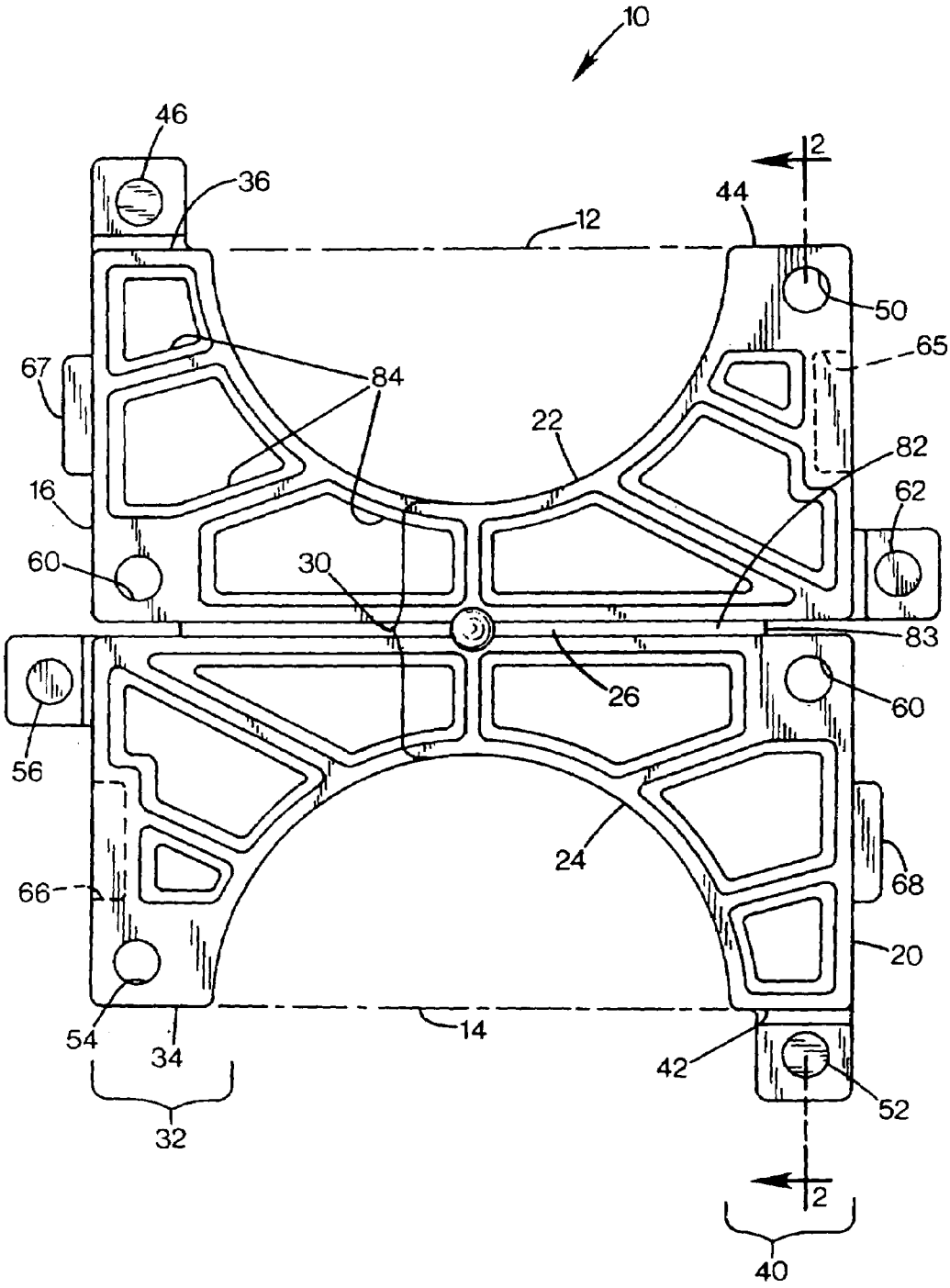
FIG. 1 is a plan view of a support structure module according to a preferred embodiment of the invention.

FIG. 1 illustrates a support structure module 10, which is preferably molded of a rigid thermoplastic such as styrene or ABS (acrylonitrile butadiene styrene.) The module is a generally flat body having a generally square shape overall. The square has an upper edge 12, opposed lower edge 14, left side edge 16, and right side edge 20. While discussed in these terms for clarity in reference to the illustration, the module need not be oriented in the manner illustrated.

An upper semicircular cutout 22 is defined in the module, and centered on the upper edge 12. The cutout has a diameter that is a major fraction of the module's nominal width as defined between the sides 16 and 20. In the preferred embodiment, the sides of the square are 6.25 inches, and the cutout diameter is 4.25 inches. The thickness is preferably 0.35 inches. All these dimensions may vary depending on the needs of the application. A lower semicircular cutout 24 is similarly defined at the lower edge 14, in a manner symmetrical about a horizontal mid-line 26 of the module with respect to the upper cutout 22.

Within the shape of the square that circumscribes it, the module has a modified "H" shape, with a cross bar 30 extending from side 16 to side 20. A left bar 32 extends along side 16 from a lower end 34 to an upper end 36. A right bar 40 extends along side 20 from a lower end 42 to an upper end 44.

The module has connector elements on all sides, so that a set of like modules may be interconnected in a matrix. The module has four female connectors and four male connectors, one of each edge. On the top edge 12, an upper male connector 46 extends from the left upper end 36 along the left side edge 16, and an upper female connector 50 is defined in end 44 along the right side edge 20. On the lower edge 14, a lower male connector 52 extends from the right lower end 42 along the right side edge 20, and an lower female connector 54 is defined in end 34 along the left side edge 16. On the left edge 16, a left male connector 56 extends from the edge just below the mid-line 26, and a left female connector 60 is defined along the left side edge 16 just above the midline. On the right side edge 20, a right male connector 62 extends from the edge just above the mid-line 26, and a right female connector 60 is defined along the right side edge 16 just below the midline. The connectors are arranged so that the module may be rotated 180 degrees within the plane of the figure, and the same form, fit, and function is provided. Each male connector button 46, 52, 56, 62 is sloped to form a ramp that tapers in an orthogonal direction away from the body of the module, in a direction perpendicular to the edge from which the connector element protrudes. In addition, pockets 65 and 66 are formed along the upper right and lower left side edges of the module at the rear surface, to accommodate tabs 67 and 68 that extend from the upper left and lower right edges. These mating tabs and pockets prevent vertical and lateral shifting of the modules when interconnected, and particularly provide that the male connectors remain biased against the female connectors to avoid unwanted disconnection.

Figure 2:
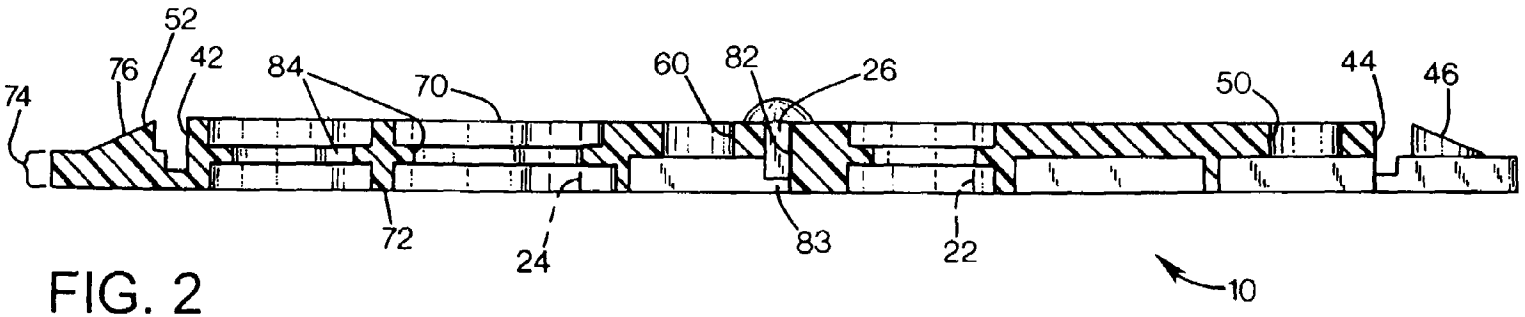
FIG. 2 is a sectional side view of the module of FIG. 1, taken along line 2-2.

As shown in FIG. 2, the module 10 has a front face 70 and a rear face 72, although these are not absolute descriptions, but merely used for reference and clarity. Each male connector comprises a half thickness portion 74 of the module body that is flush with the front surface, with a cylindrical button 76 extending from the portion 74. The female portions are circular apertures defined in half thickness portions that are flush with the rear face 72. The male buttons and female apertures are sized for a close fit, so that when adjacent modules are interlinked, the half thickness portion of the male connector resides in the recess above the female connector, and the button occupies the aperture. The male connectors protrude beyond the periphery of the square that nominally defines the module, so that they overlap onto the female connectors within the square of the adjacent module.

The module defines a groove or channel 82 along the midline 26, so that a remaining web 83 connects the two halves of the module. This facilitates breaking the module in two parts, for the upper and lower rows of a matrix, as will be discussed below. For material conservation, the module defines numerous openings 84 that provide a truss-like appearance.

Figure 3:
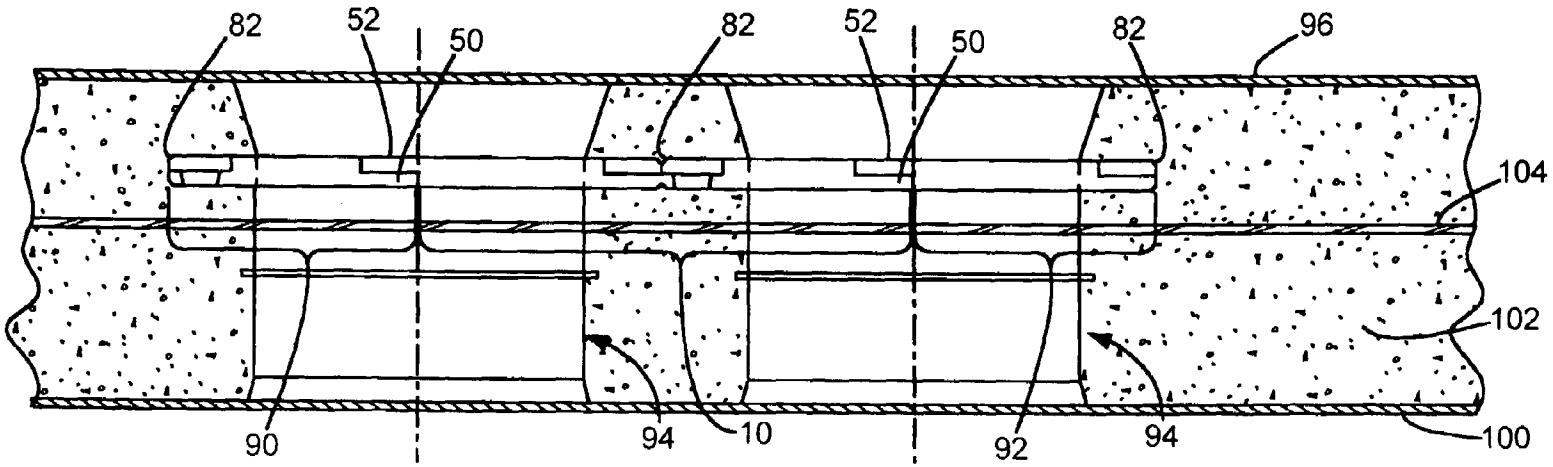
FIG. 3 is a sectional side view of a wall structure according to the preferred embodiment of the invention.

FIG. 3 shows a cross section of a concrete wall including several modules 10 in a sample arrangement. A whole module 10, shown in side edge view, is connected to a first half module 90 and a second half module 92. The half modules are broken from a single whole module, and their groove edges 82 face away from the central module. The male connector 52 of the center module is connected to the female aperture 50 of the first half module, as is the male connector 46 (not visible) of the first half module connected to the female connector 54 (not visible) of the whole module 10. The second half module is similarly connected to the whole module. A larger array can be created by using additional whole modules between the half modules.

Together, the modules 10, 90, and 92 define two circular apertures that closely receive cylindrical duct or core elements 94. The cores extend between the inner surfaces of form boards 96, 100 that are spaced apart to provide a space to contain poured concrete 102 that hardens to form the wall. A grid of reinforcing bar (rebar) 104 is positioned between the forms, and the modules are secured to the grid before concrete is poured to ensure that the cores are cast in the desired position. The cores exclude concrete from the volumes they occupy, so that cables, conduits, pipes and the like may be subsequently passed through the wall without drilling or sawing of concrete or rebar.

Figure 4:
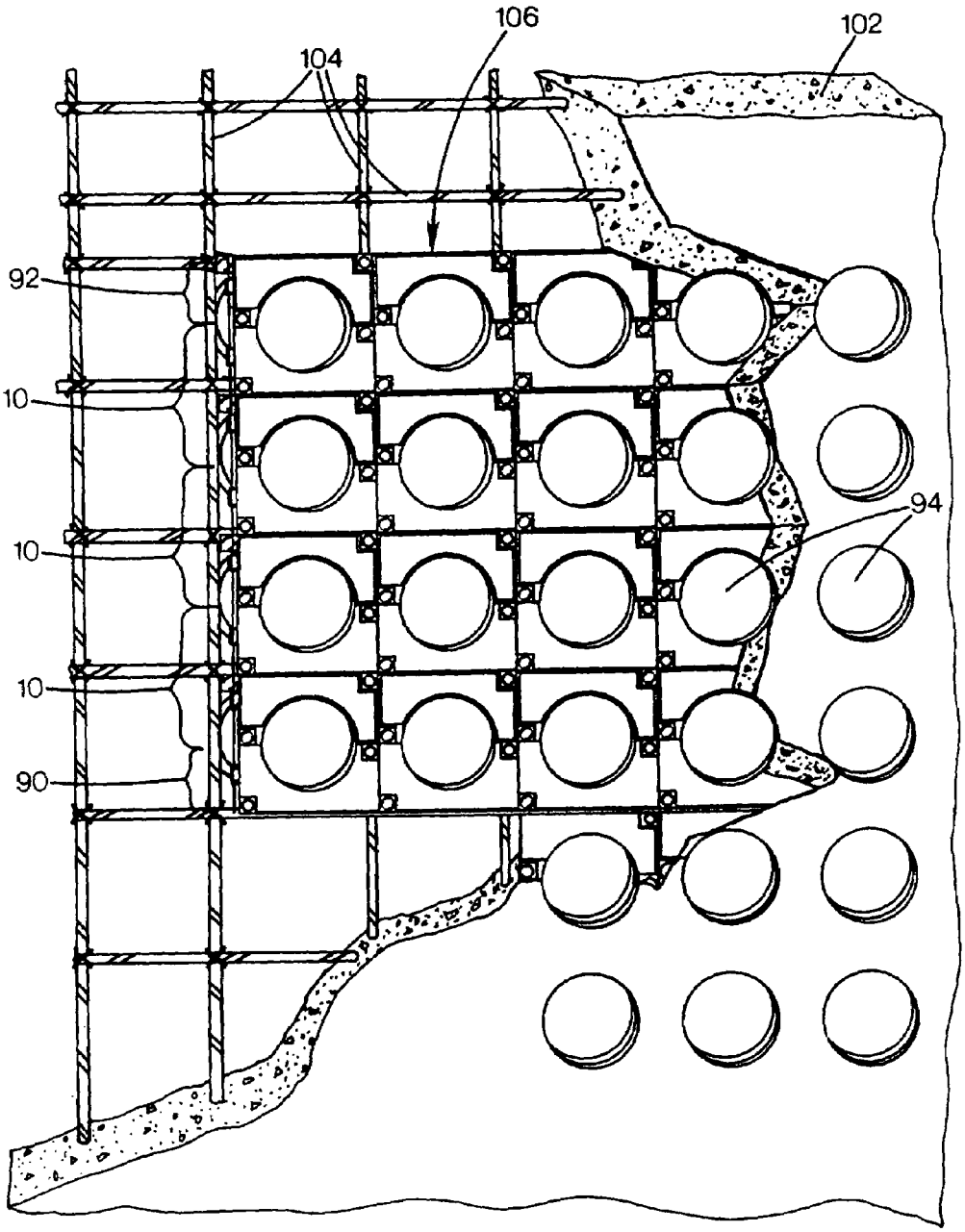
FIG. 4 is a fragmentary view of a wall structure according to the preferred embodiment of the invention.

A grid or matrix 106 of modules 10 is shown in FIG. 4, with a concrete vault wall 102 cut away to show the grid and rebar 104. The cores 94 are exposed at each surface, and include membranes or covers that prevent dirt and water outside on one side of the wall from passing through to the other prior to penetration by a conduit of wire. The rebar 104 is arranged in a grid with spacing established to fit one core within each defined square grid space. Thus, for pre-welded rebar grid, the modules should be formed with the same dimensions to avoid interference between cores and rebar. In alternative installations, the rebar grid may have an opening sized and shaped to receive the matrix of modules, with the rebar at the periphery supporting and locating the matrix, with no rebar passing between the cores.

The grid 106 illustrates one example of the many flexible alternative shapes that may be formed with the modules. It has some rows and columns with fewer apertures for cores than others. The lower left corner has no modules. This may be useful to reduce waste of modules, to avoid needless and structurally weakening apertures, and to provide a space for other special large apertures. For instance, a wall with a large conduit, window, door, lifting hook or other aperture or element several times larger than the standard modules may have a frame of modules and cores about the large central aperture. The flexible arrangement allows modules to be omitted from peripheral and central portions of the grid, to form any shape. The only limitation on shape is that each aperture be orthogonally adjacent to at least one other aperture.

ALTERNATIVE EMBODIMENT

Figure 5:
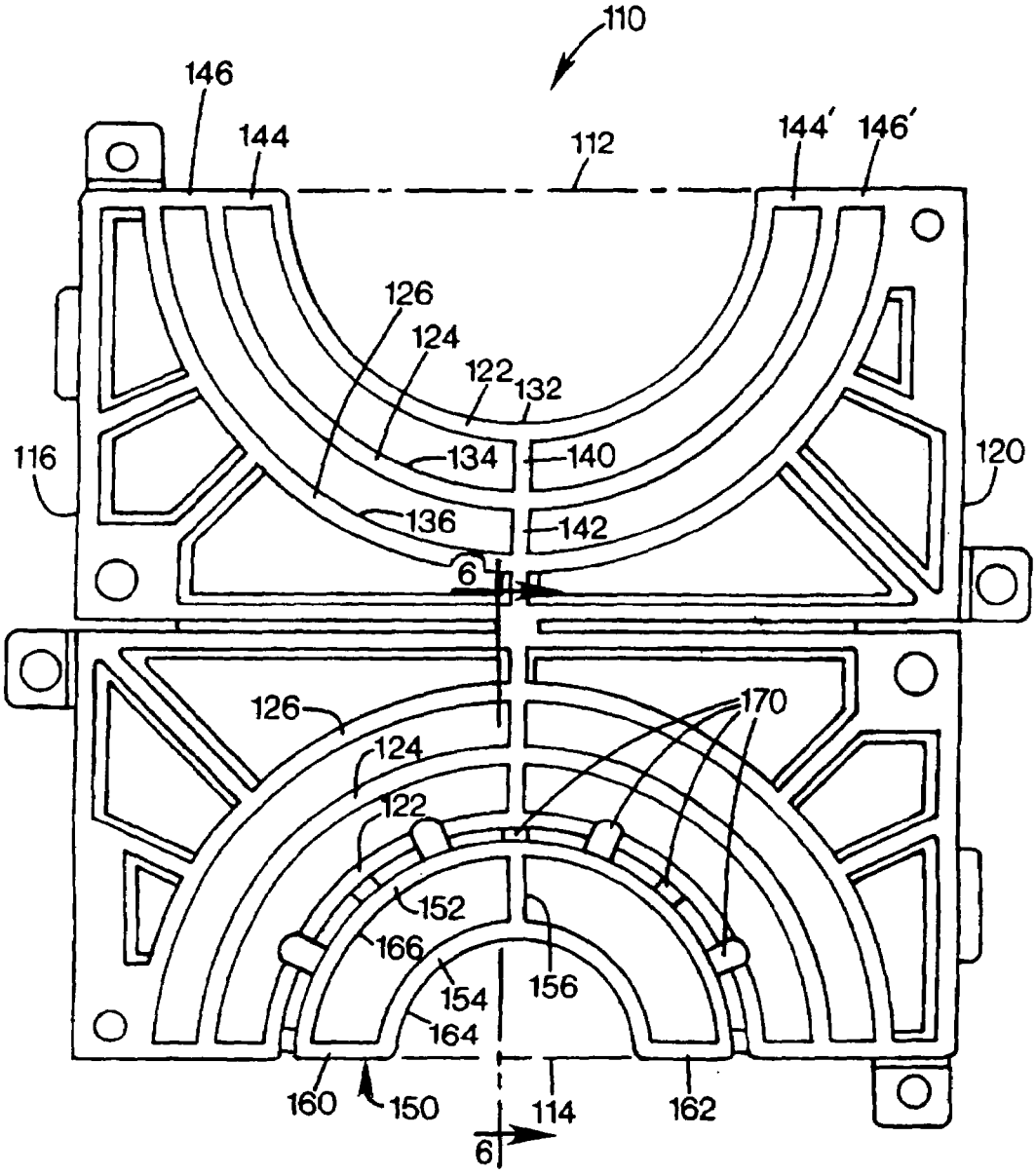
FIG. 5 is a plan view of a support structure module according to an alternative embodiment of the invention.

FIG. 5 shows illustrates a support structure module 110, which is preferably molded of a rigid thermoplastic such as styrene or ABS. The module is a generally flat body having a generally square shape overall. The square has an upper edge 112, opposed lower edge 114, left side edge 116, and right side edge 120. While discussed in these terms for clarity in reference to the illustration, the module need not be oriented in the manner illustrated.

The module is essentially the same as that illustrated in FIG. 1 above, except as described below. While the FIG. 1 module 10 has only a single arc-shaped element defining each of the cutouts 22 and 24, the FIG. 5 embodiment has a series of concentric arcs. One or more of these arcs can be removed to provide an enlarged radius of arc, so that inserts of different sizes may be accommodated by a single type of module.

A first semicircular band 122 is defined in the module, and is centered on the upper edge 12. A second band 124 and a third band 126 are semicircles concentric with the first band, and of different radii. Each band has a respective semicylindrical inner face 132, 134, 136, and the faces have respective radii of 2⅛, 2¾, and 3¼ inches. These are selected to accommodate standard fitting sizes, and in alternative embodiments, these may be of any suitable desired size. Each band has a thickness of ⅛ inch, and a width (the overall thickness of the module) of ⅜ inch.

The third and largest band 126 is connected to the rest of the module's frame at numerous locations, and may be connected in alternative embodiments with a web extending beyond it. The third band 126 remains connected to the module in all possible configurations. The first and second bands are connected to the rest of the frame by only a few connections that may readily be cut with hand tools (such as an angle cutter or small saw) at a job site. A central connection 140, 142 connects the first band to the second, and the second to the third. End connections 144, 144', 146, 146' connect the ends of the bands, and are in line with the module edge 12. Each connection has the same ⅛ inch×⅜ inch dimension as a band.

In addition to the three diameters provided by the removable bands, a semicircular insert 150 is shown attached to the band 122 of the lower cutout in FIG. 5. For convenience, the insert is shown in only one cutaway of the module, although it may be installed in both, or neither depending on the needs of the assembly formed by multiple modules. The insert has a larger outer band 152, and a smaller concentric inner band 154, with a central connector 156 and end connectors 160, 162 connecting the ends of the bands. The inner band has a semicylindrical face 164 with a radius of 1⅛ inch, and the outer band has a semicylindrical face 166 with a radius of 1⅞ inch. The insert is a separately molded plastic part that removably attaches to the module 110. The inserts and modules may be provided separately, so that inserts can be fastened as needed, or they may be provided in the illustrated pre-assembled condition, so that inserts can be removed as needed. As with the main module, the inner band of the insert may be removed by cutting the three attachments to provide an aperture defined by the insert's outer band.

Figure 6:
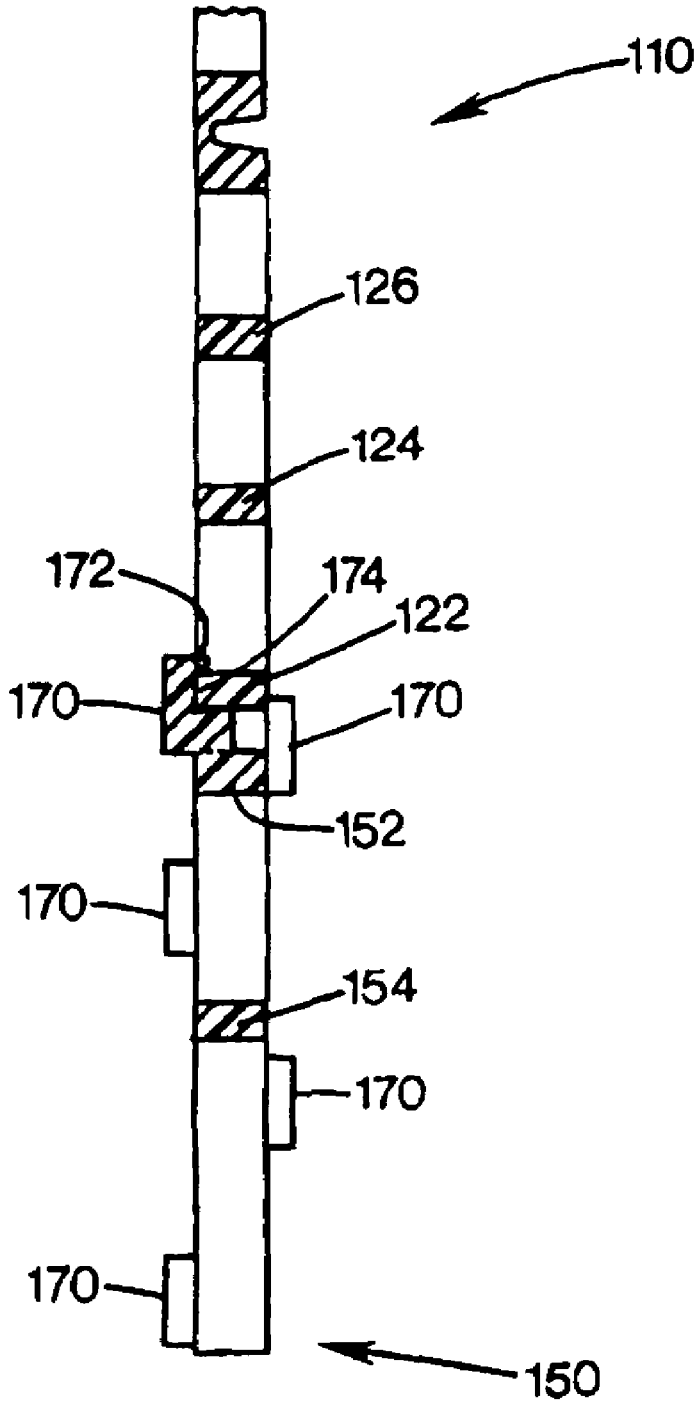
FIG. 6 is a sectional side view of the module of FIG. 5, taken along line 6-6.

The insert includes an array of latch tabs 170 that extend radially from the outer band. The tabs protrude from the planar major faces of the insert, with inner faces coplanar with the major faces to define a gap that receives the band 122 of the module. As shown in FIG. 6, each tab 170 has a protrusion 172 that engages the module band 122, to prevent removal of the insert when installed. The inner faces 174 of the tabs maintain a coplanar relationship between the module and the insert.

Figure 7:
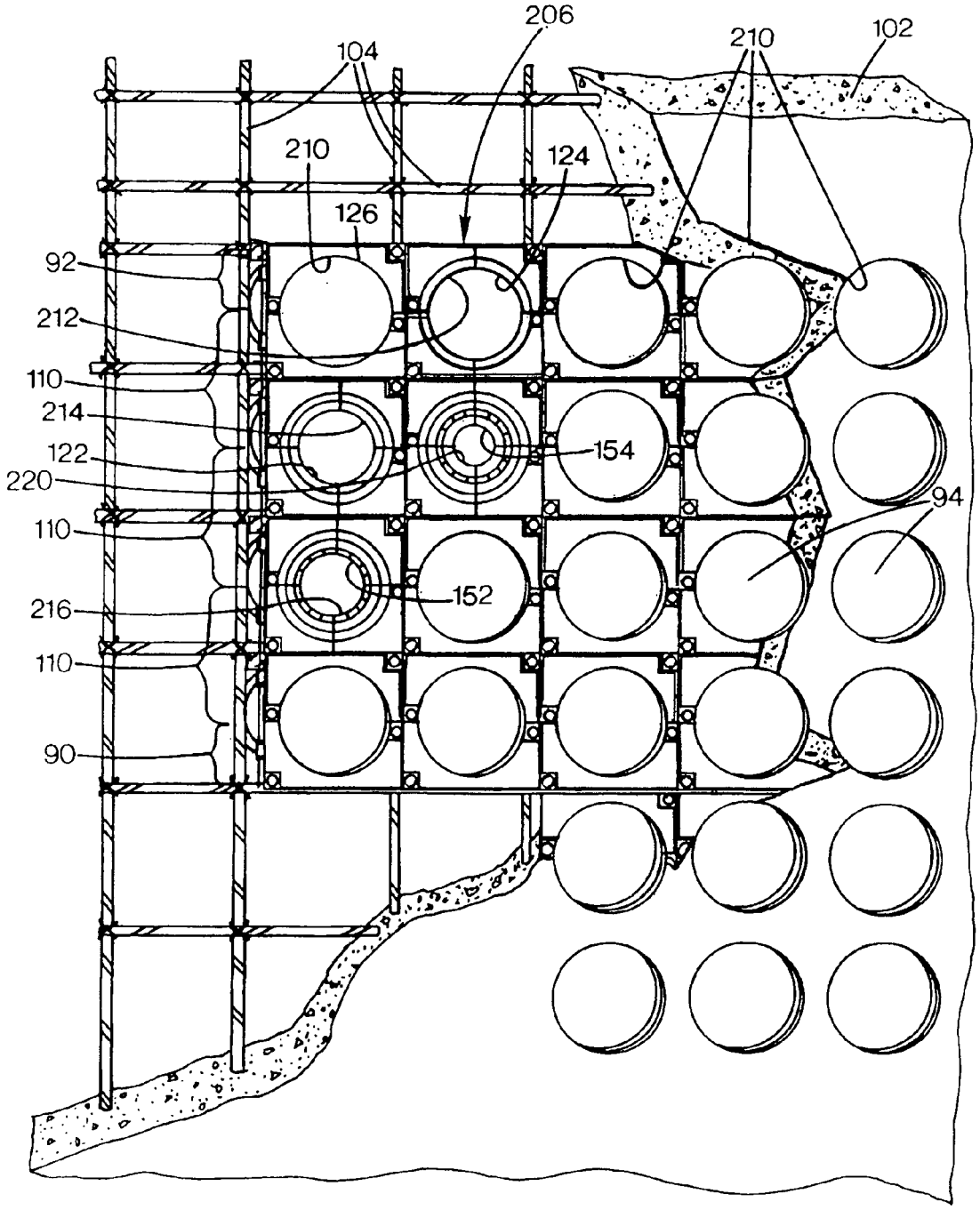
FIG. 7 is a fragmentary view of a wall structure according to the embodiment of FIG. 5.

FIG. 7 shows a grid or matrix 206 of modules 110, with a concrete vault wall 102 cut away to show the grid and rebar 104. The cores 94 are exposed at each surface, and include membranes or covers that prevent dirt and water outside on one side of the wall from passing through to the other prior to penetration by a conduit of wire. The rebar 104 is arranged in a grid with spacing established to fit one core within each defined square grid space. Thus, for pre-welded rebar grid, the modules should be formed with the same dimensions to avoid interference between cores and rebar. In alternative installations, the rebar grid may have an opening sized and shaped to receive the matrix of modules, with the rebar at the periphery supporting and locating the matrix, with no rebar passing between the cores.

FIG. 7 shows that some of the core openings have different diameters due to different module bands being present or removed. Most elements are shown in a maximum aperture condition 210 with no insert 150, and with bands 122 and 124 removed so that the largest band 126 defines the opening for the core.

The next largest aperture condition 212 is provided by the removal of band 122, so that band 124 defines the aperture. A smaller aperture condition 214 employs the intact module with no bands removed, and without an insert. Smaller still is aperture condition 216, which employs the insert, but with the inner band 154 removed. The smallest aperture condition 220 is provided by the use of an intact insert 150.

While the disclosure is made in terms of preferred and alternative embodiments, the invention is not intended to be so limited.

The invention claimed is:

1. A support module for interconnecting to like support modules for supporting a plurality of core elements for encapsulation within a concrete structure comprising:

a planar frame defining a first cutout and a second cutout facing different directions such that each is operable to engage a different like support module;

each cutout having an arc shape such that a plurality of cutouts of different modules define a circular aperture for closely receiving one of the core elements;

each cutout having a first peripheral arc portion and a second arc portion larger than the first portion and concentric therewith, such that the first portion provides an aperture of a first diameter, and upon removal of the first portion, the second portion provides an aperture of a larger second diameter;

the first peripheral arc portion and a second arc portion being formed of a single material as a unitary element;

the frame having connection elements operable to connect with other support modules to securely receive the core elements; and wherein the first arc portion is formed separately from the frame.

2. The module of claim 1 wherein the first portion is connected to the rest of the frame via a limited number of connections, such that the first portion may be removed by severing the connections.

3. The module of claim 1 wherein the first portion is connected to the second portion at only three locations.

4. The module of claim 3 wherein the first portion is an elongated arc, and is connected to the second portion only at the ends of the arc, and at a midpoint.

5. The module of claim 1 wherein the first and second portions are semicircular bands spaced apart from each other along substantially their entire lengths by at least an arcuate gap.

6. The module of claim 1 wherein a majority of the first portion is separated from the second portion by a gap.

7. The module of claim 1 wherein the first arc portion is removably fastened to the frame.

8. The module of claim 1 including a separate arcuate element removably fastened to the frame to define an aperture smaller than the first aperture.

9. The module of claim 8 wherein the separate element includes a plurality of concentric arc portions of different radii such that the removal of a smaller one of the arc portions of the separate element provides a selected radius less than the radius of the first peripheral arc portion.

10. A support module for interconnecting to like support modules for supporting a plurality of core elements for encapsulation within a concrete structure comprising:

a planar frame defining a first cutout and a second cutout facing different directions such that each is operable to engage a different like support module;

each cutout having an arc shape such that a plurality of cutouts of different modules define a circular aperture for closely receiving one of the core elements;

each cutout having a first peripheral arc portion and a second arc portion larger than the first portion and concentric therewith, such that the first portion provides an aperture of a first diameter, and upon removal of the first portion, the second portion provides an aperture of a larger second diameter;

the first peripheral arc portion and a second arc portion being formed of a single material as a unitary element;

the frame having connection elements operable to connect with other support modules to securely receive the core elements; and including a third arc portion larger than and concentric with the second portion.

11. A core element support structure for supporting core elements for encapsulation within a concrete structure comprising:

a plurality of support modules;

the modules defining a plurality of circular apertures;

each aperture defined by at least two modules;

the modules being interconnected in two orthogonal directions;

at least a first one of the modules having a first arcuate portion having a first radius and a second arcuate portion concentric with the first portion and having a greater radius, the first portion being separably connected to the second portion, such that the defined aperture has the first radius;

wherein the first arcuate portion and second arcuate portion are semicircular bands spaced apart from each other along substantially their entire lengths by at least an arcuate gap; and at least a second one of the modules having the first portion removed to define an aperture of the second radius.

12. The structure of claim 11 wherein at least one of the apertures includes an inner arcuate element fastened to a first portion of one of the modules to define an aperture having a radius less than the first radius.

13. The structure of claim 11 wherein the first portion of the first one of the modules is connected to the rest of the frame via a limited number of connections, such that the first portion may be removed by severing the connections.

14. The structure of claim 13 wherein the first portion is connected to the second portion at only three locations.

15. The structure of claim 14 wherein the first portion is an elongated arc, and is connected to the second portion only at the ends of the arc, and at a midpoint.

16. The structure of claim 13 wherein the first arc portion is removably fastened to the frame.

17. The structure of claim 13 wherein the first arc portion is fanned separately from the frame.

18. The structure of claim 12 wherein at least one of the apertures is defined by at least a removable arc portion.

19. A support module for interconnecting to like support modules for supporting a plurality of core elements for encapsulation within a concrete structure comprising:

a planar frame defining a first cutout and a second cutout;

each cutout having an arc shape such that a plurality of cutouts of different modules define a circular aperture for closely receiving one of the core elements;

each cutout having a first peripheral arc portion and a second arc portion larger than the first portion and concentric therewith, such that the first portion provides an aperture of a first diameter, and upon removal of the first portion, the second portion provides an aperture of a larger second diameter;

the first peripheral arc portion and the second arc portion being semicircular bands spaced apart from each other along substantially their entire lengths by at least an arcuate gap; and the frame having connection elements operable to connect with other support modules to securely receive the core elements.

* * * * *